US011274402B1

(12) United States Patent
Fujimoto et al.

(10) Patent No.: US 11,274,402 B1
(45) Date of Patent: Mar. 15, 2022

(54) VIBRATION ROLLER CONTROL DEVICE, CONTROL METHOD, AND VIBRATION ROLLER

(71) Applicant: Sakai Heavy Industries, Ltd., Tokyo (JP)

(72) Inventors: Hiroaki Fujimoto, Kawagoe (JP); Fusayoshi Koike, Kawagoe (JP)

(73) Assignee: Sakai Heavy Industries, Ltd., Tokyo (JP)

( * ) Notice: Subject to any disclaimer, the term of this patent is extended or adjusted under 35 U.S.C. 154(b) by 0 days.

(21) Appl. No.: 17/007,578

(22) Filed: Aug. 31, 2020

(51) Int. Cl.
*E01C 19/28* (2006.01)
*B06B 1/16* (2006.01)

(52) U.S. Cl.
CPC ..... *E01C 19/286* (2013.01); *B06B 1/16* (2013.01); *E01C 19/282* (2013.01)

(58) Field of Classification Search
CPC ..... E01C 19/282; E01C 19/286; B06B 1/16
USPC ..... 404/84.05, 113, 117
See application file for complete search history.

(56) References Cited

U.S. PATENT DOCUMENTS 5,082,396 A * 1/1992 Polacek ..... E02D 3/032 404/102
6,431,790 B1 * 8/2002 Anderegg ..... E01C 19/288 366/116
9,737,910 B2 * 8/2017 Smith ..... E01C 19/286
10,443,201 B2 * 10/2019 Meindl ..... E02D 3/026
2003/0026657 A1 * 2/2003 Gasper ..... E01C 19/286 404/117
2003/0223816 A1 * 12/2003 Potts ..... E02D 3/026 404/117
2007/0120515 A1 * 5/2007 Clary ..... F16F 15/223 318/625
2010/0139424 A1 * 6/2010 Wagner ..... B06B 1/166 74/61
2020/0018019 A1 * 1/2020 Rudge ..... E01C 23/07

FOREIGN PATENT DOCUMENTS

JP 2017-128880 A 7/2017

* cited by examiner

*Primary Examiner* — Raymond W Addie
(74) *Attorney, Agent, or Firm* — Banner & Witcoff, Ltd.

(57) ABSTRACT

A control device for controlling a vibrating roller that generates vibration on a front wheel and a rear wheel, includes a front wheel vibration start signal output unit that outputs a front wheel vibration start signal for starting vibration of the front wheel so as to give vibration at a predetermined number of times to a road surface to be constructed per unit length, a calculation unit that calculates the rear wheel vibration start timing based on a time width required from the start of vibration of the rear wheel to the vibration at a frequency that can give vibration to the road surface to be constructed a predetermined number of times, and a rear wheel vibration start signal output unit which outputs a rear wheel vibration start signal which starts the vibration of the rear wheel at the rear wheel vibration start timing.

6 Claims, 9 Drawing Sheets

VIBRATION ROLLER CONTROL DEVICE, CONTROL METHOD, AND VIBRATION ROLLER

TECHNICAL FIELD

The present invention relates to a control device and a control method of a vibrating roller, and a vibrating roller that vibrates a drum and compacts a pavement surface or the like.

BACKGROUND ART

A vibrating roller that compacts a pavement surface is known, in which a vibration exciting shaft including an eccentric weight provided inside a drum of one or both of a front wheel and a rear wheel is rotated by a hydraulic motor to generate vibration on the drum (see, for example, Patent Literature 1). The vibrating roller compacts the pavement surface by a force due to vibration and vehicle weight.

CITATION LIST

Patent Literature

Patent Literature 1: JP-A-2017-128880

SUMMARY OF INVENTION

Technical Problem

Although an existing asphalt road surface and a new asphalt road surface to be constructed are present in a construction site of an asphalt pavement by such a vibrating roller, when the vibrating roller starts vibration during travelling on the existing asphalt road surface, the existing asphalt road surface might be damaged by vibration.

An object of the present invention is to provide a control device which can reduce a peak load of the vibrating roller on a vibration exciting motor by being used to control the vibrating roller, a control method, and a vibrating roller including the control device.

Solution to Problem

One aspect of the present invention capable of achieving the above object is a control device for controlling a vibrating roller that generates vibration on a front wheel and a rear wheel by rotating a vibration exciting shaft including an eccentric weight provided inside the front wheel and the rear wheel with respect to a proceeding direction by a vibration exciting motor, the control device comprises a vibration start timing calculation unit that calculates a front wheel vibration start timing for starting vibration of the front wheel and a rear wheel vibration start timing for starting vibration of the rear wheel, a front wheel vibration start signal output unit that outputs a front wheel vibration start signal for starting vibration of the front wheel based on the front wheel vibration start timing calculated by the vibration start timing calculation unit, and a rear wheel vibration start signal output unit that outputs a rear wheel vibration start signal for starting vibration of the rear wheel based on the rear wheel vibration start timing calculated by the vibration start timing calculation unit, wherein the vibration start timing calculation unit sets timings at which the front wheel and the rear wheel pass the same position on a road surface to be constructed as the front wheel vibration start timing and the rear wheel vibration start timing.

Since the vibrating roller provided with the control device having such a configuration starts vibration of the front wheel at a predetermined position with respect to the road surface to be constructed, and then starts vibration of the rear wheel at a timing when the rear wheel passes the predetermined position, the peak load on the vibration exciting motor can be reduced as compared with a case of vibrating both the front wheel and the rear wheel at the same time.

Moreover, according to the above mentioned control device, wherein the vibration start timing calculation unit calculates the front wheel vibration start timing and the rear wheel vibration start timing so that the front wheel and the rear wheel start vibration at timings when the front wheel and the rear wheel reach a boundary position of the road surface to be constructed.

The vibrating roller provided with the control device having such a configuration can certainly compact the new asphalt road surface by vibration while preventing damage to the existing asphalt road surface in front of the new asphalt road surface to be applied, for example, during construction of the asphalt pavement or the like.

Moreover, according to the above mentioned control device, wherein the vibration start timing calculation unit calculates the front wheel vibration start timing and the rear wheel vibration start timing so that the front wheel and the rear wheel start vibration at a timing just before a time width required from the start of vibration of each of the front wheel and the rear wheel until vibration at a vibration frequency which can give vibration at a predetermined number of times to the road surface to be constructed with respect to a timing at which the front wheel and the rear wheel reach the boundary position of the road surface to be constructed.

The vibrating roller provided with the control device having such a configuration can make the compaction density constant by more certainly giving vibration of a predetermined number of times to the road surface to be applied while preventing damage to the existing asphalt road surface in front of the new asphalt road surface to be applied as much as possible, for example, during construction of the asphalt pavement or the like.

Moreover, according to the above mentioned control device, wherein the vibration start timing calculation unit calculates a time width from the front wheel vibration start timing to the rear wheel vibration start timing based on a travelling speed of the vibrating roller and a wheel base between the front wheel and the rear wheel.

Moreover, according to the above mentioned control device, wherein the predetermined number of times is set between 10 and 15 times per foot of the road surface to be constructed.

In a case where the road surface to be constructed is a new asphalt road surface, the number of times of vibration of the compaction construction is preferably set within the above range.

Moreover, according to the above mentioned control device, wherein the predetermined number of times is set between 10 and 12 times per foot of the road surface to be constructed.

In a case where the road surface to be constructed is a new asphalt road surface, the number of times of vibration of the compaction construction is more preferably set within the above range.

Another aspect of the present invention is a vibrating roller comprising a pair of drums as a front wheel and a rear wheel each including a vibration exciting shaft having an eccentric weight inside, a vibration exciting motor for vibrating one or both of the pair of drums, and the any one of above mentioned control device.

Another aspect of the present invention is a control method for controlling a vibrating roller that generates vibration on a drum by rotating a vibration exciting shaft including an eccentric weight provided inside one or both of a front wheel and a rear wheel with respect to a proceeding direction by a vibration exciting motor, the control method comprises calculating a front wheel vibration start timing for starting vibration of the front wheel and a rear wheel vibration start timing for starting vibration of the rear wheel, starting vibration of the drum as the front wheel so as to give vibration at a predetermined number of times to a road surface to be constructed per unit length, starting vibration of the front wheel based on the calculated front wheel vibration start timing, starting vibration of the rear wheel based on the calculated rear wheel vibration start timing, calculating a timing at which the drum as the front wheel starts vibration and the drum as the rear wheel can vibrate the road surface to be constructed at the predetermined number of times, and starting vibration of the drum as the rear wheel at the calculated timing, wherein timings at which the front wheel and the rear wheel pass the same position on the road surface to be constructed are set as the front wheel vibration start timing and the rear wheel vibration start timing.

Advantageous Effects of Invention

According to the control device and the control method of the vibrating roller and the vibrating roller according to the present invention, for example, during construction of the asphalt pavement, the peak load of the vibrating roller on the vibration exciting motor can be reduced.

DESCRIPTION OF EMBODIMENTS

Figure 1:
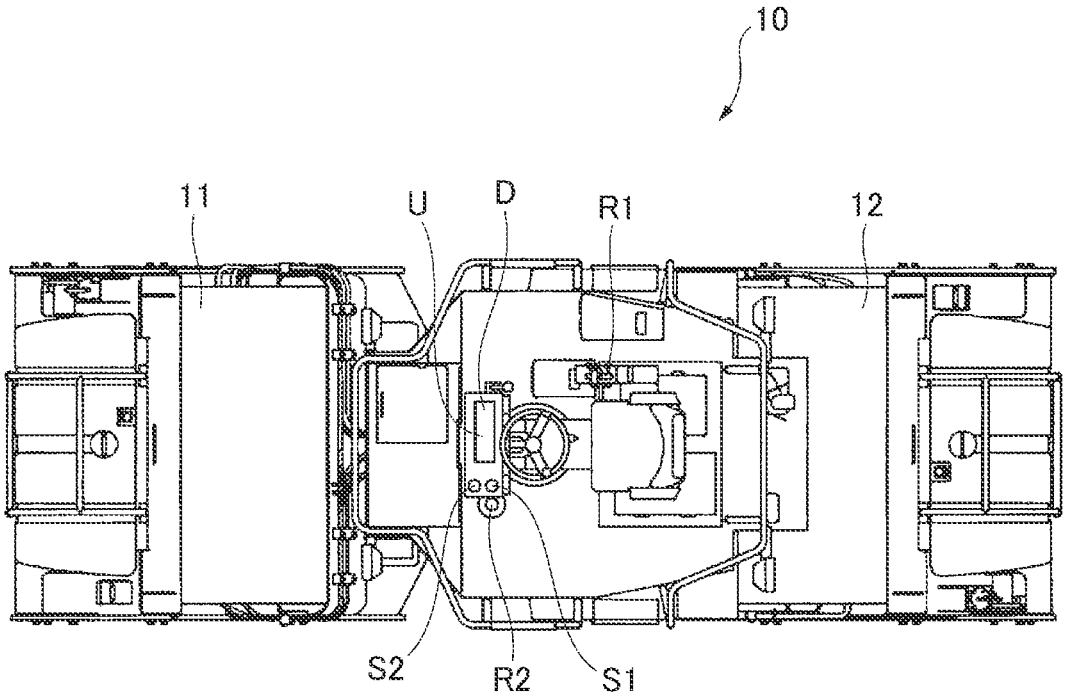
FIG. 1 is a plan view of a vibrating roller according to an embodiment of the present invention.
Figure 2:
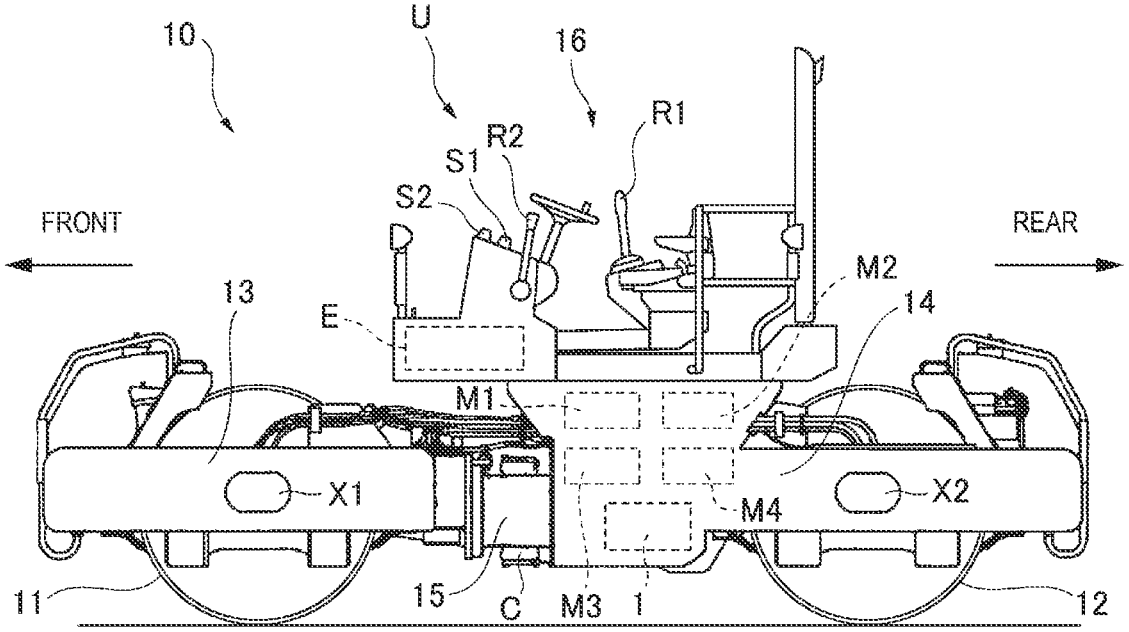
FIG. 2 is a side view of the vibrating roller according to the embodiment of the present invention.

Embodiments of the present invention will be described with reference to the drawings, FIG. 1 shows a plan view of a vibrating roller 10 according to the present embodiment. FIG. 2 is a side view of the vibrating roller 10. As shown in FIG. 1 and FIG. 2, the vibrating roller 10 includes a first drum 11, a second drum 12, a front vehicle body 13, a rear vehicle body 14, and a coupling portion 15 that couples the front vehicle body 13 and the rear vehicle body 14. A driver seat 16 is provided at an upper portion of the rear vehicle body 14. When viewed from an operator sitting at the driver seat, the first drum is installed on a front side of the vibrating roller 10, and the second drum is installed on a rear side of the vibrating roller 10.

The first drum 11 is installed on the front vehicle body 13 (shaft mounted). The second drum 12 is installed on the rear vehicle body 14 (shaft mounted). The vibrating roller 10 is an articulated vibrating roller in which the front vehicle body 13 and the rear vehicle body 14 are rotatable around a vertical axis C about the coupling portion 15. The vibrating roller 10 can perform compaction construction of compacting a new asphalt road surface or the like by advancing or reversing the first drum 11 and the second drum 12 as rolling compaction wheels.

Further, the rear vehicle body 14 is provided with an engine E as a drive source, a front travelling motor M1 for travelling of the first drum 11, a rear travelling motor M2 for travelling of the second drum 12, a front vibration exciting motor M3 for vibrating the first drum 11, a rear vibration exciting motor M4 for vibrating the second drum 12, and a control device 1 that controls operations of the travelling motors M1 and M2 and the vibration exciting motors M3 and M4. The travelling motors M1 and M2 and the vibration exciting motors M3 and M4 include, for example, a hydraulic motor.

An advance or reverse lever R1 capable of switching advance or reverse of the vehicle is provided on a seat side of the driver seat 16. The advance or reverse lever R1 is configured to be switched among an advance position, a neutral position, and a reverse position. A lever R2 capable of changing a rotation speed of the engine E is provided on a handle side of the driver seat 16. The rotation speed of the engine E can be changed depending on an inclination angle of the lever R2. When the vibrating roller 10 travels on a road surface to be constructed and performs a compaction operation, the inclination angle of the lever R2 is generally set such that the engine E has maximum output. The advance or reverse lever R1 and the lever R2 are connected to the control device 1.

A display unit D on which operation information of the vibrating roller 10 is displayed and an operation unit U for an operator to perform various kinds of operation on the vibrating roller 10 are provided on an operation panel of the driver seat 16. The operation unit U is provided with a vibration switch S1 capable of switching ON/OFF of vibration of the first drum 11 and the second drum 12 and a changeover switch S2 capable of switching set vibration frequencies. The vibration switch S1 and the changeover switch S2 of the operation unit U are connected to the control device 1.

The front vehicle body 13 supports the first drum 11 so as to be capable of rotating and vibrating. A vibration exciter case is provided inside the first drum 11 and a vibration exciting shaft X1 that vibrates the first drum 11 is incorporated in the vibration exciter case. An eccentric weight Y1 (see FIG. 3) is fixed to the vibration exciting shaft X1. The first drum 11 can be vibrated by rotating the vibration exciting shaft X1 to which the eccentric weight Y1 is fixed by a front vibration exciting motor M3.

The rear vehicle body 14 supports the second drum 12 so as to be capable of rotating and vibrating. A vibration exciter case is provided inside the second drum 12, and a vibration exciting shaft X2 that vibrates the first drum 12 is incorporated in the vibration exciter case. An eccentric weight Y2 (see FIG. 3) is fixed to the vibration exciting shaft X2. The second drum 12 can be vibrated by rotating the vibration exciting shaft X2 to which the eccentric weight Y2 is fixed by a rear vibration exciting motor M4.

The control device 1 drives the travelling motors M1 and M2 to rotationally drive the first drum 11 and the second drum 12 of the vibrating roller 10. Further, the control device 1 drives the vibration motors M3 and M4 to vibrate the first drum 11 and the second drum 12 of the vibrating roller 10. Further, the control device 1 calculates, for example, a vibration start timing of the first drum 11 which is started by the vibration exciting motor M3 and a vibration start timing of the second drum 12 which is started by the vibration exciting motor M4 based on the vibration frequencies of the first drum 11 and the second drum 12, an impact per foot (IPF) which is a blow number (vibration frequency) per foot, a travelling speed of the vibrating roller 10, and the like.

Figure 3:
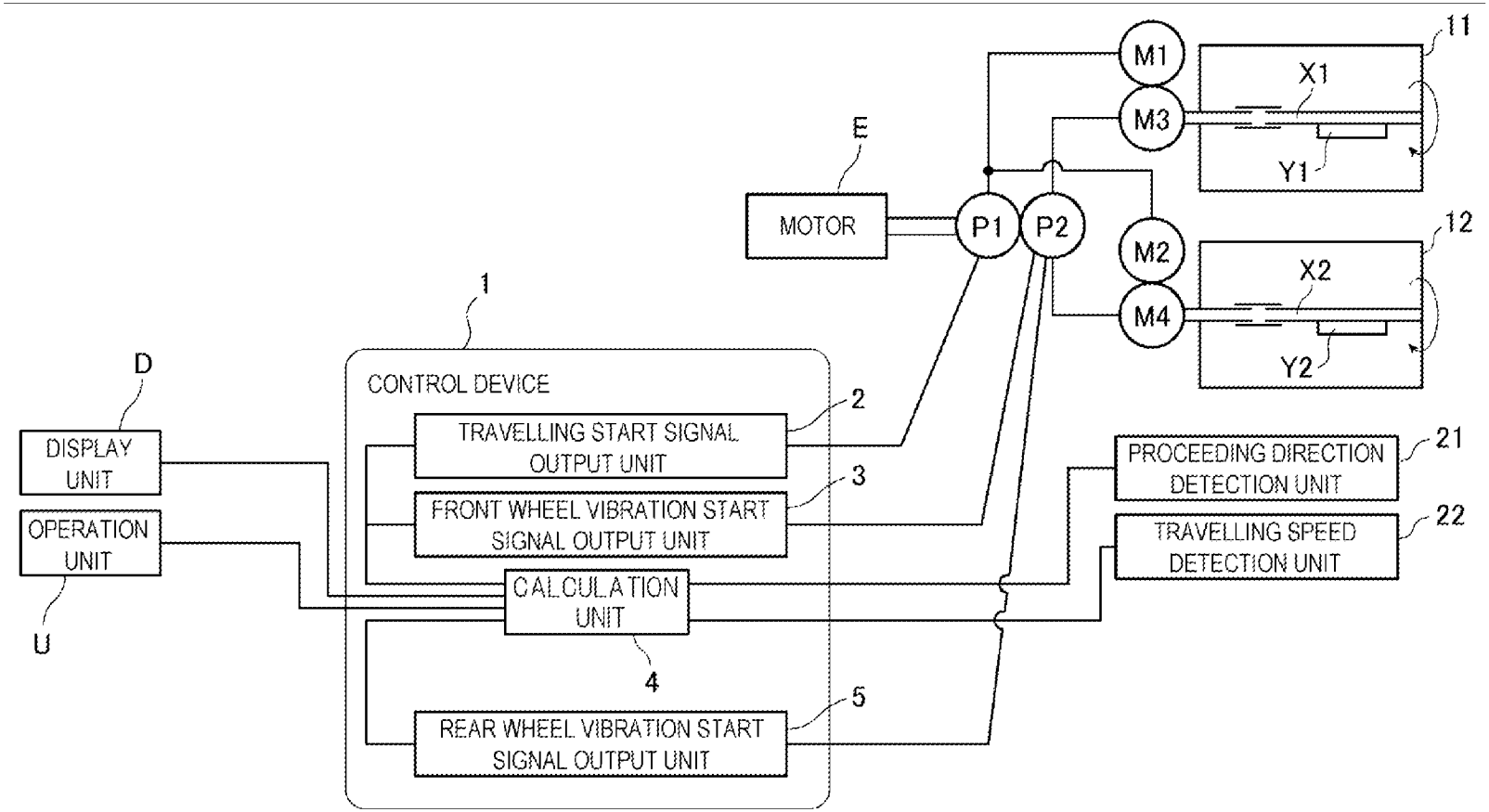
FIG. 3 is a function block diagram of a control device included in the vibrating roller.

FIG. 3 is a function block diagram of the control device 1 included in the vibrating roller 10. As shown in FIG. 3, the control device 1 includes a travelling start signal output unit 2, a front wheel vibration start signal output unit 3, n a calculation unit 4 (an example of a vibration start timing calculation unit), and a rear wheel vibration start signal output unit 5. The "front wheel" and the "rear wheel" mean a front wheel and a rear wheel with respect to a proceeding direction in the vibrating roller 10 where compaction construction is possible in both advance and reverse directions. Therefore, when the vibrating roller 10 advances, the first drum 11 is the front wheel, and the second drum 12 is the rear wheel. On the other hand, when the vibrating roller 10 reverses, the second drum 12 is the front wheel, and the first drum 11 is the rear wheel.

The travelling start signal output unit 2 outputs a travelling start signal for starting travelling of the first drum 11 and the second drum 12. The travelling start signal output from the travelling start signal output unit 2 is transmitted to a travelling hydraulic pump P1. Although the travelling hydraulic pump P1 is a hydraulic pump using the engine E as a power source, the travelling hydraulic pump P1 operates by receiving the travelling start signal. As a result, operating oil is supplied to the travelling motors M1 and M2, and the first drum 11 and the second drum 12 start rotating. The travelling start signal is output by laying down the lever R2 and laying down the advance or reverse lever R1 by the operator.

The front wheel vibration start signal output unit 3 outputs a front wheel vibration start signal for starting vibration of the front wheel to a vibration hydraulic pump P2 at a timing when the operator turns on the vibration switch S1. The front wheel vibration start signal output unit 3 may output the front wheel vibration start signal at a front wheel vibration start timing calculated by the calculation unit 4 as will be described later. The vibration start signal output from the vibration start signal output unit 3 is transmitted to the vibration hydraulic pump P2. The vibration hydraulic pump P2 is a hydraulic pump using the engine E as the power source, but is operated by the front wheel vibration start signal from the front wheel vibration start signal output unit 3, and supplies operating oil to the front vibration exciting motor M3. As a result, the vibration exciting shaft X1 rotates, and the first drum 11 starts vibration.

The rear wheel vibration start signal output unit 5 outputs a rear wheel vibration start signal for starting vibration of the rear wheel to a vibration hydraulic pump P2 at a timing when the operator turns on the vibration switch S1. The rear wheel vibration start signal output unit 5 may output the rear wheel vibration start signal at a rear wheel vibration start timing calculated by the calculation unit 4 as will be described later. The rear wheel vibration start signal output from the rear wheel vibration start signal output unit 5 is transmitted to the vibration hydraulic pump P2. The vibration hydraulic pump P2 is operated by the rear wheel vibration start signal from the rear wheel vibration start signal output unit 5, and supplies operating oil to the rear vibration exciting motor M4. As a result, the vibration exciting shaft X2 rotates, and the second drum 12 starts vibration.

The timing at which the operator turns on the vibration switch S1 is, for example, a timing at which the first drum 11 which is the front wheel and the second drum 12 which is the rear wheel reach a boundary position of the road surface to be constructed. As a result, during construction of asphalt pavement or the like by the vibrating roller 10, it is possible to certainly perform compaction by vibration on the new asphalt road surface while preventing damage to the existing asphalt road surface in front of the new asphalt road surface to be constructed.

When vibration of the first drum 11 as the front wheel is started, the vibration frequency thereof does not reach the preset frequency immediately, and a certain degree of timing occurs before reaching. Therefore, the timing at which the operator turns on the vibration switch S1 may be a timing before the timing at which the first drum 11 as the front wheel and the second drum 12 as the rear wheel reach the road surface to be constructed by a predetermined time width. Here, the predetermined time width is a time width required until stable vibration at a vibration frequency that can give vibration at a preset number of times per unit length of the road surface to be constructed after each of the first drum 11 as the front wheel and the second drum 12 as the rear wheel starts vibration and a vibration frequency thereof rises and stabilizes. As a result, during construction of asphalt pavement or the like by the vibrating roller 10, the first drum 11 and the second drum 12 of the vibrating roller 10 vibrate at vibration frequencies required for starting vibration in front of boundary positions of the new asphalt road surface to be constructed and the existing asphalt road surface in front of the new asphalt road surface by a predetermined distance (a distance by which the vibrating roller 10 advances in the above time width) and compacting the road surface to be constructed when reaching the boundary positions.

It is possible to make a compaction density constant by more certainly vibrating for the number of times required for compacting the road surface to be constructed from a start position of the road surface to be constructed while preventing damage as much as possible. The timing at which the first drum 11 as the front wheel and the second drum 12 as the rear wheel start vibration may be calculated by the calculation unit 4, and in this case, the display unit D may display a timing at which the operator should perform operation such as "turn on the vibration switch S1 1 m in front of the boundary position of the road surface to be constructed" on the vibration switch S1. As a result, the operator can easily recognize a timing (position) at which vibration is started for more certainly giving vibration of the number of times required for the first drum 11 and the second drum 12 to compact the road surface to be constructed from the start position of the road surface to be constructed. When the timing at which the first drum 11 and the second drum 12 start vibration is calculated by the calculation unit 4, the first drum 11 and the second drum 12 may be automatically vibrated at the calculated timing without being operated by the operator.

More specifically, for example, the calculation unit 4 calculates the timing at which the first drum 11 as the front wheel should start vibration based on detection results (proceeding direction and travelling speed) from a proceeding direction detection unit 21 for detecting the proceeding direction (advance direction and reverse direction) of the vibrating roller 10 and a travelling speed detection unit 22 for detecting the travelling speed of the vibrating roller 10, and automatically starts vibration of the first drum 11 when the timing comes. Then, the calculation unit 4 calculates the timing at which the second drum 12 should start vibration based on the detection results (the travelling speed of the vibrating roller 10) from the travelling speed detection unit 22 and a wheel base between the first drum 11 and the second drum 12. That is, in the calculation unit 4, time required for the vibrating roller 10 to travel by a distance corresponding to the wheel base between the first drum 11 and the second drum 12 from the timing at which the first drum 11 starts vibration elapses, and then the second drum 12 starts vibration.

The display unit D provided on the operation panel of the driver seat 16 and the operation unit U are connected to the calculation unit 4. The display unit D displays the travelling speed of the vibrating roller 10, vibration states of the first and second drums 11 and 12, a setting value of the IPF, and the like. The vibration frequencies, IPFs, and the like of the first and second drums 11 and 12 can be input to the operation unit U. The number of setting times of the IPF is set in a range of preferably 10 to 15, more preferably 10 to 12.

The proceeding direction detection unit 21 includes a gyro sensor, an acceleration sensor, and the like. The travelling speed detection unit 22 includes, for example, a rotary encoder capable of detecting the rotation speed of the front and rear travelling motors M1 and M2.

Next, an operation example of the vibrating roller 10 will be described with reference to FIG. 4.

Figure 4:
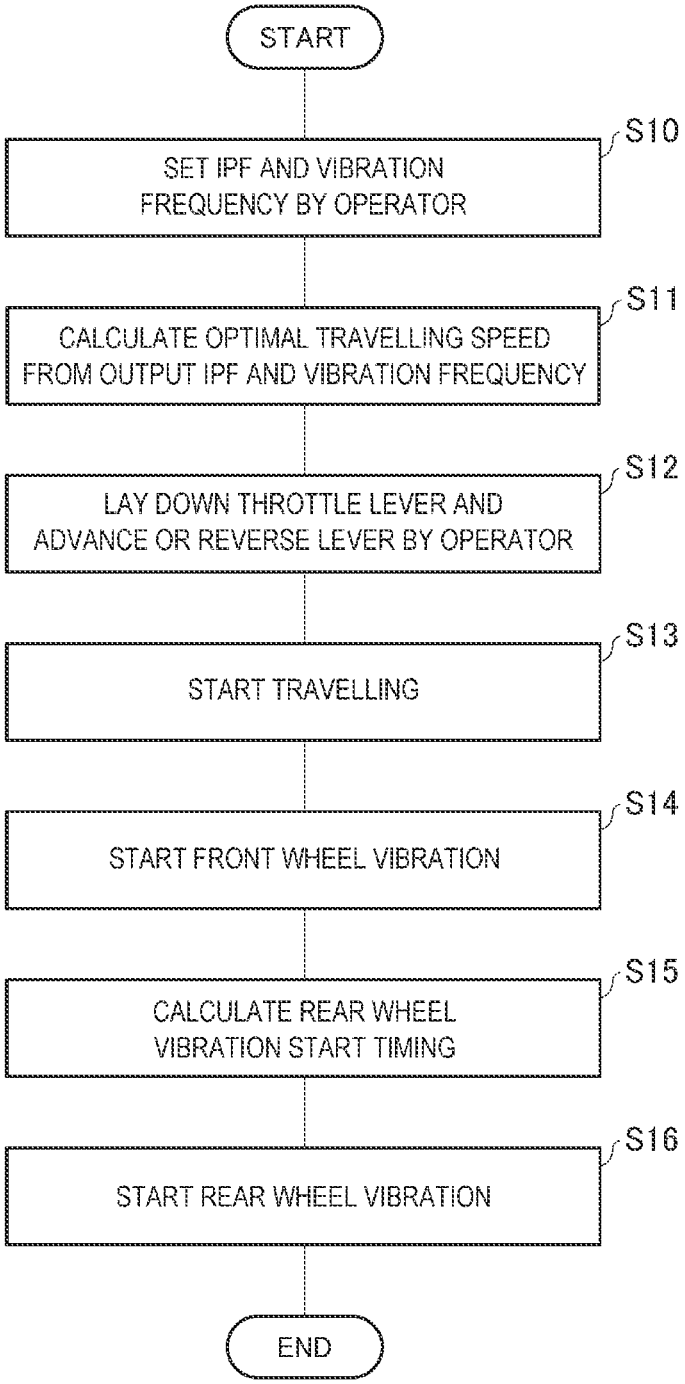
FIG. 4 is a flowchart of a compaction construction operation on a new asphalt road surface by the vibrating roller.

FIG. 4 is a flowchart illustrating the operation of the vibrating roller 10 when compaction work is performed on the new asphalt road surface.

The operator activates the engine E of the vibrating roller 10 and inputs the IPFs and the vibration frequencies of the first drum 11 and the second drum 12 via the operation unit U on the operation panel of the driver seat 16. As a result, the IPFs and the vibration frequencies of the first drum 11 and the second drum 12 in the compaction construction of the vibrating roller 10 are set (step S10). For example, the IPFs are set to 12 times and the vibration frequencies are set to 2400 rpm. Set setting information is displayed on the display unit D on the operation panel.

Based on the input IPFs and vibration frequencies of the first drum 11 and the second drum 12, the calculation unit 4 calculates an optimum travelling speed (3.6 km/h in this example) of the vibrating roller 10 in the compaction construction (step S11). The calculated travelling speed is set as the travelling speed of the vibrating roller 10 and is stored in a memory of the calculation unit 4. At this time, the compaction construction has not yet started, and the vibrating roller 10 is located on the existing asphalt road surface.

Next, the operator lays down the lever R2 and the advance or reverse lever R1 (step S12). In this operation example, a case in which the advance or reverse lever R1 is laid down on the advance position side and compaction by advance travelling of the vibrating roller 10 is constructed is described. An operation state of the advance or reverse lever R1 is displayed on the display unit D as, for example, "advance setting". An operation state of the changeover switch S2 is displayed on the display unit D as, for example, "set vibration frequency of 2400 rpm".

When the lever R2 and the advance or reverse lever R1 are laid down, a travelling start signal is transmitted from the travelling start signal output unit 2 of the control device 1 to the travelling hydraulic pump P1. The travelling hydraulic pump P1 that has received the travelling start signal supplies operating oil to the travelling motors M1 and M2. By supplying the operating oil, the travelling motors M1 and M2 rotate the first drum 11 and the second drum 12. As a result, the vibrating roller 10 starts travelling in the travelling speed set in step S11 (step S13).

Next, the operator turns on the vibration switch S1 for vibrating the first drum 11 as the front wheel. The vibration switch S1 is turned on at a time point before a time point when the first drum 11 as the front wheel reaches the road surface to be constructed. The timing at which the vibration switch S1 is turned on can be specified based on time required until the first drum 11 as the front wheel can give a preset predetermined number of times of vibration to the road surface to be constructed. The operator turns on the vibration switch S1 while visually confirming a position of the new asphalt road surface to be constructed, for example. Alternatively, the operator may turn on the vibration switch S1 while referring to calculation information such as "turn on the vibration switch S11 m in front of the construction site" which is calculated by the calculation unit 4 and displayed on the display unit D. By turning on the vibration switch S1, the front wheel vibration start signal is transmitted from the front wheel vibration start signal output unit 3 toward the vibration hydraulic pump P2. The vibration hydraulic pump P2 that has received the front wheel vibration start signal operates by power from the engine E. and circulates the operating oil from the vibration hydraulic pump P2 to the front vibration exciting motor M3. By circulating the operating oil, the front vibration exciting motor M3 rotates the vibration exciting shaft X1, and vibration of the first drum 11 as the front wheel is started (step S14). As a result, the first drum 11 as the front wheel vibrates at a predetermined number of times set at the time point when reaching the road surface to be constructed.

The calculation unit 4 calculates a rear wheel vibration start timing T1 for starting vibration of the second drum 12 of the rear wheel based on start of vibration of the first drum 11 as the front wheel (step S15). The calculation unit 4 detects a proceeding direction of the vibrating roller 10 based on the information from the proceeding direction detection unit 21.

The calculation unit 4 detects the travelling speed of the vibrating roller 10 based on information from the travelling speed detection unit 22. Based on the vibration frequency (2400 rpm in this example) of the second drum 12 set in step S10, the calculation unit 4 calculates time t1 required from the start of vibration of the second drum 12 until a vibration frequency thereof reaches a vibration frequency that can give vibration at the IPF (12 times) set in step S10. Relationships between "vibration frequency", "IPF", and "time t1" are stored in advance in the calculation unit 4 as a table.

Further, based on the detected travelling speed of the vibrating roller 10 and a distance L between the first drum 11 as the front wheel and the second drum 12 as the rear wheel, the calculation unit 4 calculates time t2 required for the second drum 12 as the rear wheel to move by the distance L. Based on the calculated time t2, the calculation unit 4 calculates a timing T2 at which the second drum 2 as the rear wheel reaches the new asphalt road surface to be constructed with a timing T0 at which the vibration switch S1 is turned on to vibrate the first drum 11 as the front wheel as a reference. The calculation unit 4 calculates a timing just before the time t1 required from the timing t2 at which the second drum 12 as the rear wheel reaches the new asphalt road surface until the vibration frequency of the second drum 12 as the rear wheel reaches the vibration frequency which can give vibration at the set IPF (12 times) as the rear wheel vibration start timing T1 for starting vibration of the second drum 12 as the rear wheel. The calculation unit 4 transmits the calculated rear wheel vibration start timing T1 to the rear wheel vibration start signal output unit 5.

The rear wheel vibration start signal output unit 5 transmits the rear wheel vibration start signal for starting vibration of the rear wheel to the vibration hydraulic pump P2 based on the rear wheel vibration start timing T1 received from the calculation unit 4. The vibration hydraulic pump P2 that has received the rear wheel vibration start signal operates by power from the engine E, and circulates the operating oil from the vibration hydraulic pump P2 to the rear vibration exciting motor M4. By circulating the operating oil, the rear vibration exciting motor M4 rotates the vibration exciting shaft X2 and vibrates the second drum 12. As a result, at the rear wheel vibration start timing T1 calculated by the calculation unit 4, vibration of the second drum 12 as the rear wheel is started (step S16). When the second drum 12 as the rear wheel reaches a position of the new asphalt road surface, the vibration frequency reaches a vibration frequency which can give vibration at the set IPF (12 times) to the road surface.

For example, in step S15, the calculation unit 4 may calculate a timing at which only the time t2 has elapsed, the time required for the first drum 11 as the front wheel to move by the distance L, from the timing T0 at which the first drum 11 as the front wheel starts vibration as the rear wheel vibration start timing T1 for starting vibration of the second drum 12 as the rear wheel.

Further, although not shown in the flowchart of FIG. 4, the vibration switch S1 is turned off by the operator in order to stop vibration of the first drum 11 as the front wheel at the timing when the first drum 11 as the front wheel reaches a terminal end in the travelling direction of the new asphalt road surface which is a compaction construction section. By turning off the vibration switch S1, the vibration hydraulic pump P2 stops operation, the vibration exciting shaft X1 stops rotation by the front vibration exciting motor M3, and the first drum 11 as the front wheel stops vibration. When the first drum 11 as the front wheel stops vibration, the calculation unit 4 calculates the timing at which the second drum 12 as the rear wheel reaches the terminal end in the travelling direction of the new asphalt road surface which is the compaction construction section based on the travelling speed of the vibrating roller 10 and the distance between the first drum 11 as the front wheel and the second drum 12 as the rear wheel. Then, the second drum 12 as the rear wheel stops vibration at the timing calculated by the calculation unit 4, that is, the timing at which the second drum 12 as the rear wheel reaches the terminal end in the travelling direction of the compaction construction section.

The vibrating roller 10 which has reached the terminal end in the travelling direction of the compaction construction section then shifts to performing of the compaction work by reverse travelling. In the case of the compaction construction by reverse travelling, the vibrating roller 10 causes the second drum 12 to operate as a front wheel and causes the first drum 11 to operate as a rear wheel, and the same processing as that from step S12 to step S16 is executed.

Next, the rotation speed and torque of the engine during travelling of the vibrating roller will be described.

Figure 5:
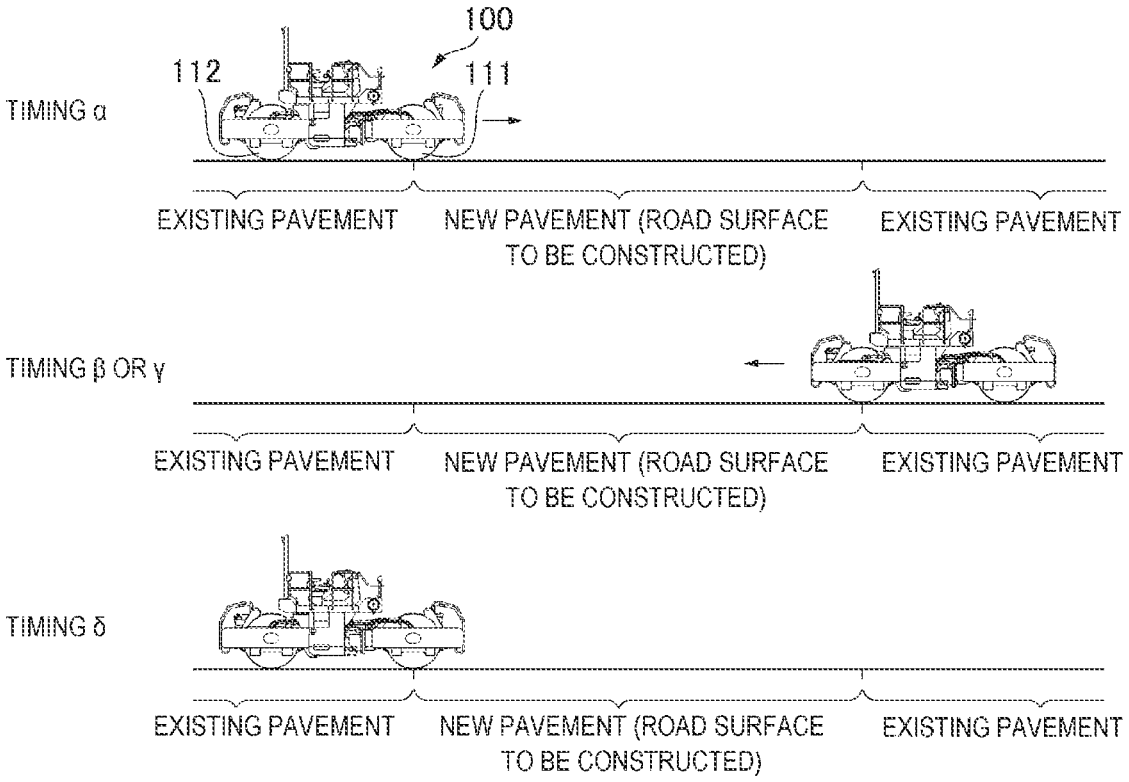
FIG. 5 is diagram showing how a related vibrating roller travels on a road surface to be constructed and performs compaction in a time series.
Figure 6:
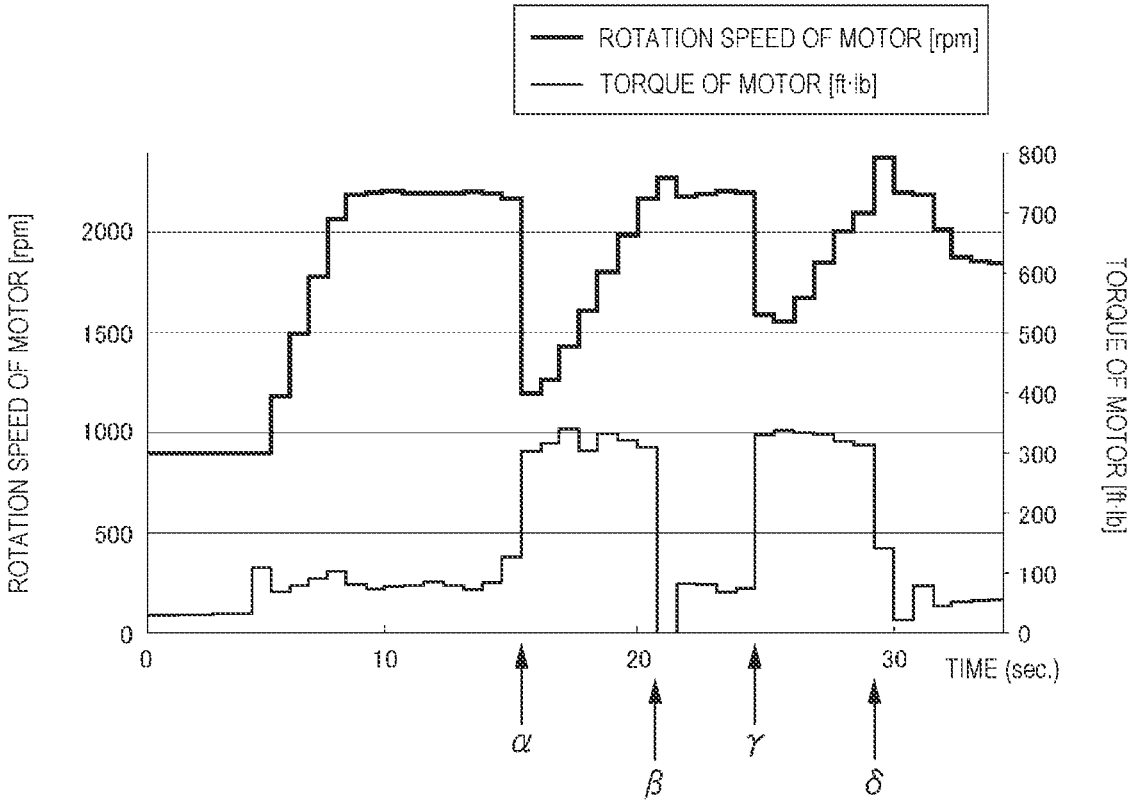
FIG. 6 is a graph showing a rotation speed and torque of a motor during travelling of the related vibrating roller.
Figure 7A:
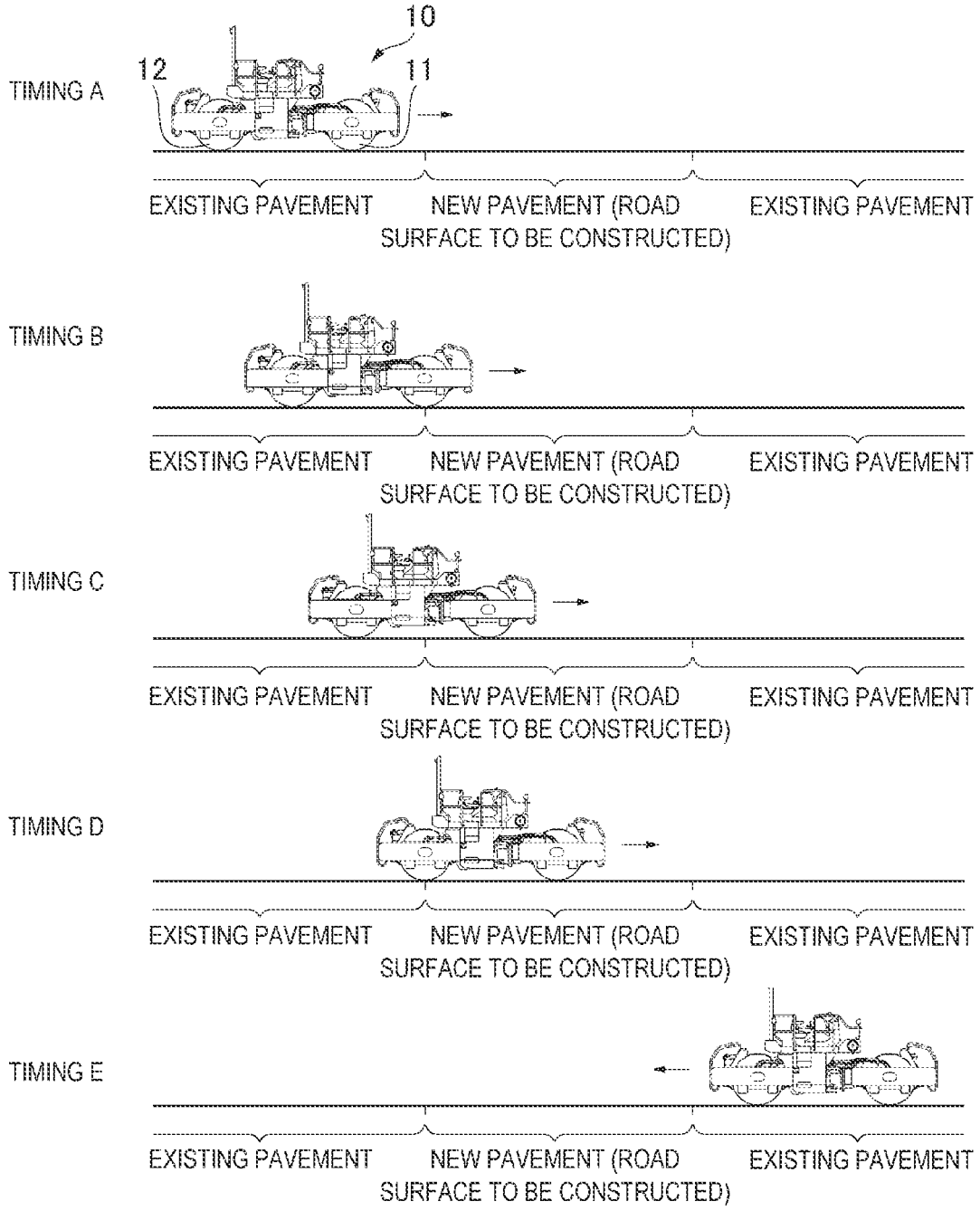
FIG. 7A is diagram showing how the vibrating roller according to the embodiment of the present invention travels on a road surface to be constructed and performs compaction in a time series.
Figure 7B:
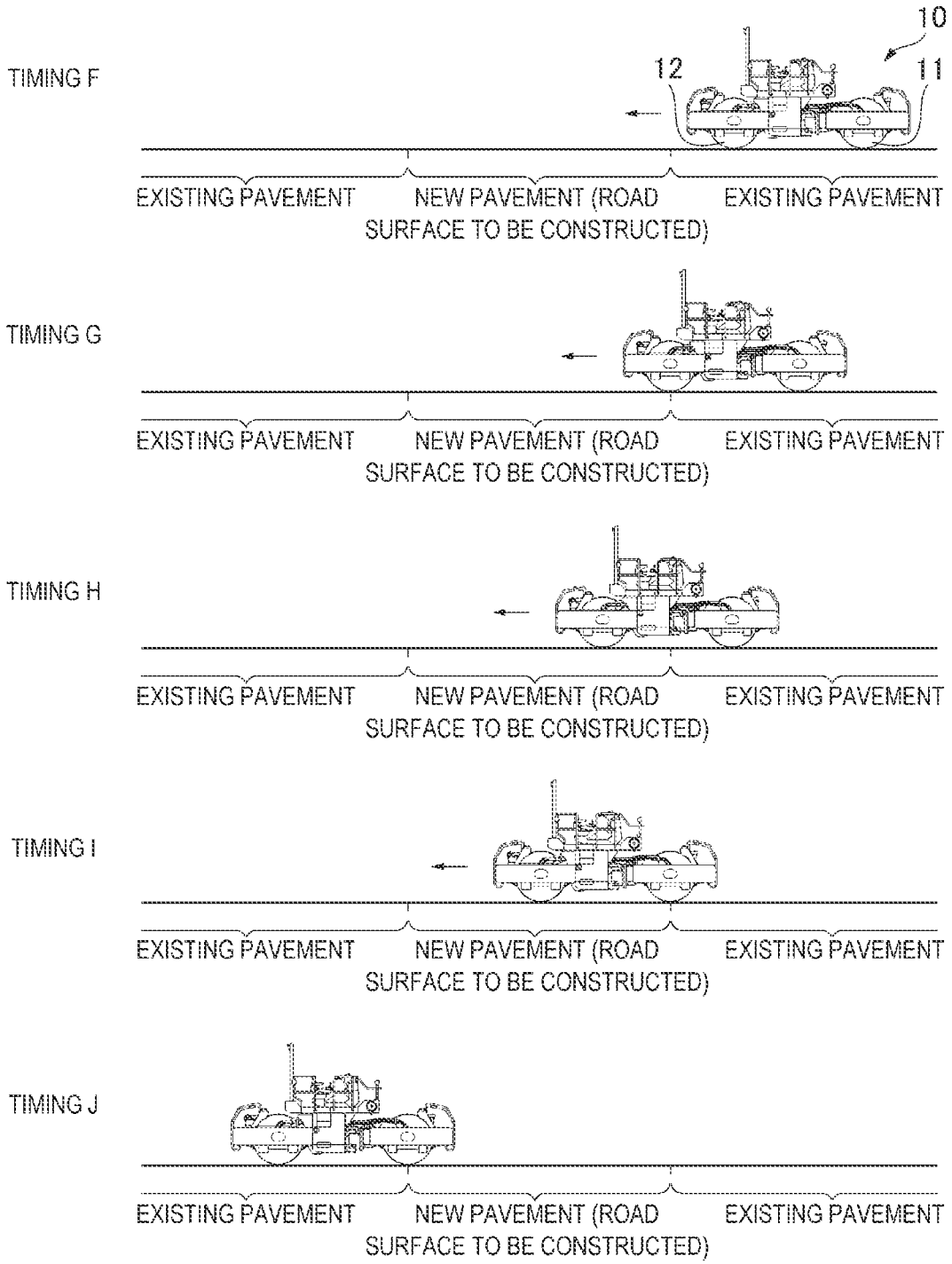
FIG. 7B is diagram showing how the vibrating roller according to the embodiment of the present invention travels on a road surface to be constructed and performs compaction in a time series.
Figure 8:
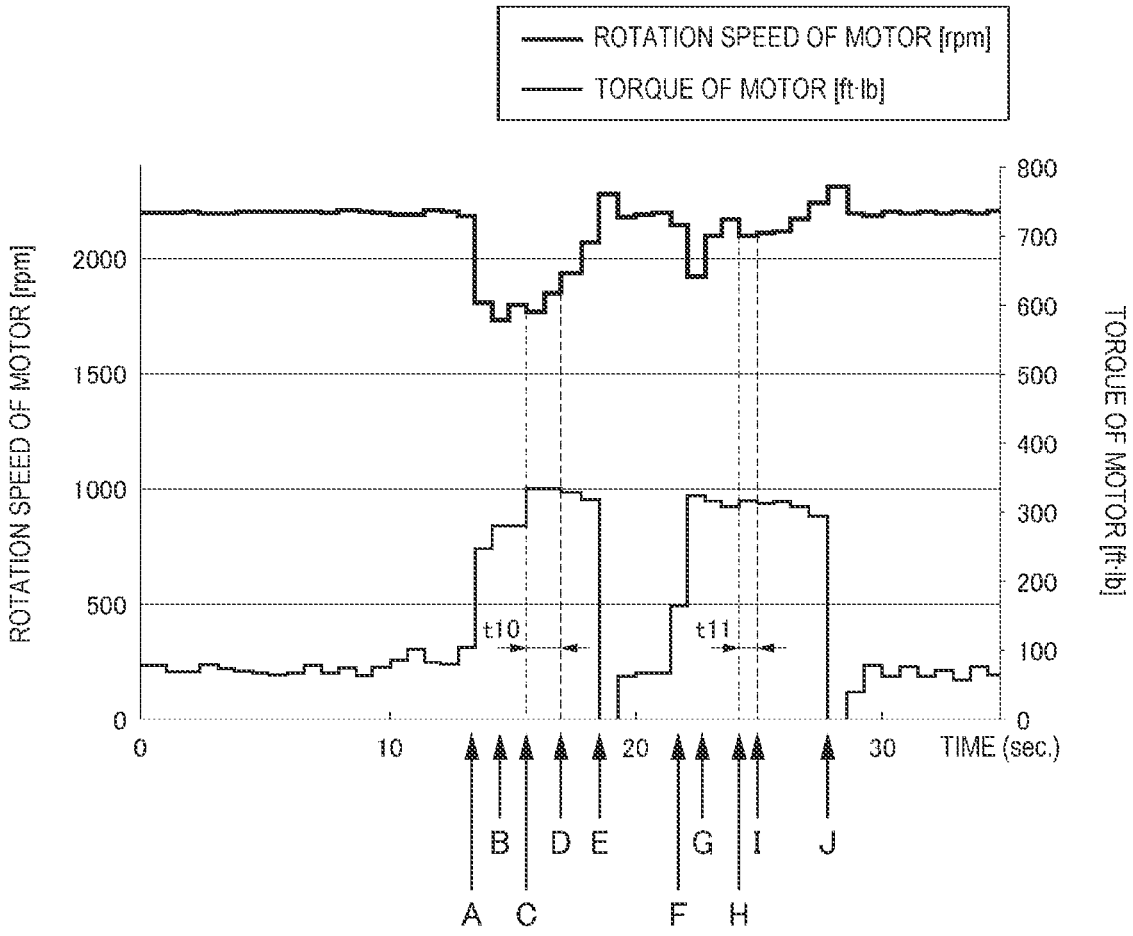
FIG. 8 is a graph showing a rotation speed and torque of a motor during travelling of the vibrating roller according to the embodiment of the present invention.

FIG. 5 is diagram showing how a related vibrating roller 100 travels on a road surface to be constructed and performs compaction in a time series. FIG. 6 is a graph showing a rotation speed and torque of an engine during travelling of the related vibrating roller 100. FIG. 7A is a diagram showing how the vibrating roller 10 according to the embodiment of the present invention travels on a road surface to be constructed and performs compaction in a time series. FIG. 7B is a diagram showing how the vibrating roller 10 continues compaction in FIG. 7A in a time series. FIG. 8 is a graph showing a rotation speed and torque of the engine E during travelling of the vibrating roller 10 according to the embodiment of the present invention. In either description of the related vibrating roller 100 performed with reference to FIG. 5 and FIG. 6 or description relating to the vibrating roller 10 according to the embodiment of the present invention performed with reference to FIG. 7A, FIG. 7B, and FIG. 8, an inclination angle of the lever R2 is set so that the engine E has a maximum rotation speed (about 2200 rpm) in a regular state.

In the related vibrating roller 100 shown in FIG. 5 and FIG. 6, when the vibration switch for vibrating the drum is turned on by the operator, the front and rear vibration exciting motors rotate the respective vibration exciting shafts at the same time, and the front wheel drum and the rear wheel drum are configured to start vibration at the same time.

In contrast, in the vibrating roller 10 according to the embodiment of the present invention shown in FIG. 7A, FIG. 7B, and FIG. 8, as described above, before the first drum 11 as the front wheel reaches the new asphalt road surface to be constructed, the operator turns on the vibration switch S1 for vibrating the first drum 11 as the front wheel, only the front vibration exciting motor M3 rotates the vibration exciting shaft X1, and only the first drum 11 as the front wheel starts vibration. After that, the rear vibration exciting motor M4 rotates the vibration shaft X2, and the second drum 12 as the rear wheel starts vibration at the rear wheel vibration start timing T1 calculated by the calculation unit 4, that is, a timing just before a time width required from the start of vibration of the second drum 12 as the rear wheel until vibration at a vibration frequency which can give vibration at a predetermined number of times to the road surface to be constructed from the timing T2 at which the second drum 12 as the rear wheel reaches the newly asphalt road surface to be constructed.

In FIG. 5, the vibrating roller 100 shown at a timing α indicates a state in which a drum 111 as a front wheel reaches a position of a new asphalt road surface, and the drum 111 as the front wheel and a drum 112 as a rear wheel start vibration at the same time based on operation of an operator in compaction construction by advance travelling. The state is a state at a timing indicated by an arrow α in FIG. 6, and the drum 111 as the front wheel and the drum 112 as the rear wheel start vibration at the same time to reduce the rotation speed of the engine.

In FIG. 5, the vibrating roller 100 shown at a timing α indicates a state in which the drum 112 as the rear wheel of the vibrating roller 100 reaches a terminal end in a travelling direction of a new asphalt road surface which is a compaction construction section, and the vibrating roller 100 stops advance travelling based on operation of the operator, and the drum 111 as the front wheel and the drum 112 as the rear wheel stop vibration in compaction construction by advance travelling. The state is a state at a timing indicated by an arrow β in FIG. 6, and the drum 111 as the front wheel and the drum 112 as the rear wheel stop vibration at the same time to reduce the torque of the engine.

In FIG. 5, the vibrating roller 100 shown at a timing γ indicates a state in which the drum 112 as a front wheel reaches a position of a new asphalt road surface, and the drum 112 as the front wheel and the drum 111 as a rear wheel start vibration at the same time based on operation of the operator in compaction construction by reverse travelling. The state is a state at a timing indicated by an arrow γ in FIG. 6, and the drum 112 as the front wheel and the drum 111 as the rear wheel start vibration at the same time to reduce the rotation speed of the engine. A decrease in the rotation speed of the engine at the timing of the arrow γ has a width smaller than that of a decrease in the rotation speed of the engine at the timing of the arrow α. This is because a load on the engine is reduced at the timing of the arrow γ when the compaction construction by reverse travelling is started since the vibration exciting shaft having the eccentric weight which starts rotation in the compaction construction by advance travelling continuously rotates by inertia even after receiving a signal for stopping vibration.

In FIG. 5, the vibrating roller 100 shown at a timing δ indicates a state in which the drum 111 as the rear wheel of the vibrating roller 100 reaches a terminal end in a travelling direction of a new asphalt road surface which is a compaction construction section, and the vibrating roller 100 stops reverse travelling based on the operation of the operator, and the drum 112 as the front wheel and the drum 111 as the rear wheel stop vibration in compaction construction by reverse travelling. The state is a state at a timing indicated by an arrow δ in FIG. 6, and the drum 112 as the front wheel and the drum 111 as the rear wheel stop vibration at the same time to reduce the torque of the engine.

In FIG. 7A, the vibrating roller 10 shown at a timing A shows a state in which the operator turns on the vibration switch S1 for vibrating the first drum 11 as the front wheel and causes only the first drum 11 as the front wheel to start vibration before the first drum 11 as the front wheel reaches the new asphalt road surface in compaction construction by advance travelling. The state is a state at a timing indicated by an arrow A in FIG. 8, and the first drum 11 as the front wheel starts vibration to reduce a rotation speed of the engine. A decrease in the rotation speed of the engine at the timing of the arrow A has a width smaller than that of a decrease in the rotation speed of the engine at the timing of the arrow α in FIG. 6. This is because the second drum 12 as a rear wheel does not start vibration at the timing of the arrow A and only the first drum 11 as the front wheel starts vibration, while the drum 111 as the front wheel and the drum 112 as the rear wheel start vibration simultaneously at the timing of the arrow α in FIG. 6.

In FIG. 7A, the vibrating roller 10 shown at a timing B indicates a state in which the first drum 11 as the front wheel reaches a position of the new asphalt road surface in the compaction construction by advance travelling. At this time, the vibration frequency of the first drum 11 as the front wheel reaches a vibration frequency that can give vibration at, for example, a set IPF of 12 times to the new asphalt road surface. The state is a state at a timing indicated by an arrow B in FIG. 8.

In FIG. 7A, the vibrating roller 10 shown at a timing C indicates a state in which the second drum 12 as the rear wheel starts vibration at the rear wheel vibration start timing T1 before reaching the new asphalt road surface in the compaction construction by advance travelling. The state is a state at a timing indicated by an arrow C in FIG. 8.

In FIG. 7A, the vibrating roller 10 shown at a timing D indicates a state in which the second drum 12 as the rear wheel reaches a position of the new asphalt road surface in the compaction construction by advance travelling. At this time, the vibration frequency of the second drum 12 as the rear wheel reaches a vibration frequency that can give vibration at, for example, a set IPF of 12 times to the new asphalt road surface. The state is a state at a timing indicated by an arrow D in FIG. 8.

In FIG. 7A, the vibrating roller 10 shown at a timing E indicates a state in which the second drum 12 as the rear wheel of the vibrating roller 10 reaches a terminal end in the travelling direction of the new asphalt road surface which is a compaction construction section, and the second drum 12 as the rear wheel stops vibration in the compaction construction by advance travelling. The state is a state at a timing indicated by an arrow E in FIG. 8.

Next, in FIG. 7B, the vibrating roller 10 shown at a timing F shows a state in which the operator turns on the vibration switch S1 for vibrating the second drum 12 as a front wheel and causes only the second drum 12 as the front wheel to start vibration before the second drum 12 as the front wheel reaches the new asphalt road surface in compaction construction by reverse travelling. The state is a state at a timing indicated by an arrow F in FIG. 8, and the second drum 12 as the front wheel starts vibration to reduce a rotation speed of the engine. The decrease in the rotation speed of the engine at the timing of the arrow F is smaller than the decrease in the engine speed at the timing of the arrow A. This is because the load on the engine E is reduced at the timing of the arrow F when the vibration exciting shaft having the eccentric weight which starts rotation by the compaction construction by advance travelling continues rotation by inertia and the compaction construction by reverse travelling is started similarly to that described at the timing γ in FIG. 5.

In FIG. 7B, the vibrating roller 10 shown at a timing G indicates a state in which the second drum 12 as the front wheel reaches a position of the new asphalt road surface in the compaction construction by reverse travelling. At this time, the vibration frequency of the second drum 12 as the front wheel reaches a vibration frequency that can give vibration at, for example, a set IPF of 12 times to the new asphalt road surface. The state is a state at a timing indicated by an arrow G in FIG. 8.

In FIG. 7B, the vibrating roller 10 shown at a timing H indicates a state in which the first drum 11 as the rear wheel starts vibration at the rear wheel vibration start timing T1 before reaching the new asphalt road surface in the compaction construction by reverse travelling. The state is a state at a timing indicated by an arrow H in FIG. 8.

In FIG. 7B, the vibrating roller 10 shown at a timing I indicates a state in which the first drum 11 as the rear wheel reaches a position of the new asphalt road surface in the compaction construction by reverse travelling. At this time, the vibration frequency of the first drum 11 as the rear wheel reaches a vibration frequency that can give vibration at, for example, a set IPF of 12 times to the new asphalt road surface. The state is a state at a timing indicated by an arrow I in FIG. 8. Time t11 between the timings H and I, that is, the time t11 from the start of vibration of the first drum 11 as the rear wheel until reaching a vibration frequency which can give vibration at the set IPF of 12 times to the new asphalt road surface in the compaction construction of reverse travelling, is shorter than time t10 between the timings C and D, that is, the time t10 from the start of vibration of the second drum 12 as the rear wheel until reaching a vibration frequency which can give vibration at the set IPF of 12 times to the new asphalt road surface in the compaction construction of advance travelling. This is because the time required until the vibration exciting shaft reaches a predetermined rotation speed in the compaction construction by reverse travelling shortens since the vibration exciting shaft having the eccentric weight which starts rotation in the compaction construction by advance travelling continuously rotates by inertia even after receiving a signal for stopping vibration.

In FIG. 7B, the vibrating roller 10 shown at a timing J indicates a state in which the first drum 11 as the rear wheel of the vibrating roller 10 reaches a terminal end in the travelling direction of the new asphalt road surface which is a compaction construction section, and the first drum 11 as the rear wheel stops vibration in the compaction construction by reverse travelling. The state is a state at a timing indicated by an arrow J in FIG. 8.

As shown in FIG. 6, in the related vibrating roller 100, since the drum 111 as the front wheel and the drum 112 as the rear wheel simultaneously start vibration at the timing of the arrow α, the rotation speed of the engine (motor) is lowered from about 2200 rpm to about 1200 rpm before the start of construction. In contrast, in the case of the vibrating roller 10 according to the embodiment of the present invention, as shown in FIG. 8, since only the first drum 11 as the front wheel starts vibration and the second drum 12 as the rear wheel does not start vibration, the rotation speed of the engine E (motor) is not lowered from about 2200 rpm to 1800 rpm before the start of construction. As a result, in the vibrating roller 10 according to the embodiment of the present invention, it is possible to reduce an increase in a load of a vibration exciting hydraulic motor at the start of compaction construction as compared with the related vibrating roller 100.

In FIG. 6, the timing of the arrow γ is a timing at which the compaction construction by reverse travelling is started after the end of the compaction construction by advance travelling, and is a timing at which the drum 112 as the front wheel and the drum 111 as the rear wheel start vibration at the same time in reverse travelling of the vibrating roller 100. In FIG. 8, the timing of the arrow F is a timing at which the compaction construction by reverse travelling is started after the end of the compaction construction by advance travelling, and is a timing at which only the second drum 12 as the front wheel starts vibration in reverse travelling of the vibrating roller 10. Even in cases of these timings, similarly to the case of advance travelling, in the vibrating roller 10 according to the embodiment of the present invention, it is possible to reduce an increase in a load of a vibration exciting hydraulic motor at the start of compaction construction as compared with the related vibrating roller 100.

As described above, according to the vibrating roller 10 of the present embodiment, the vibration start timing of the first drum 11 as the front wheel and the vibration start timing of the second drum 12 as the rear wheel are different, and the second drum 12 as the rear wheel starts vibration at a timing when a predetermined time elapses after the first drum 11 as the front wheel starts vibration. Therefore, it is possible to reduce an impact due to vibration of the second drum 12 as the rear wheel on the existing asphalt road surface during construction of asphalt pavement, and it is possible to reduce damage from occurring on the existing road surface. Further, according to the vibrating roller 10, the second drum 12 as the rear wheel starts vibration at the timing when a predetermined time elapses after the first drum 11 as the front wheel starts vibration, that is, the timing T1 just before the time t required from the timing T2 at which the second drum 12 as the rear wheel reaches the new asphalt road surface until the vibration frequency of the second drum 12 as the rear wheel reaches the set IPF (10 to 15 times). Therefore, since the second drum 12 as the rear wheel can accurately give a predetermined number of times of vibration to the new asphalt road surface, a compaction density in a construction target range can be made uniform, and construction quality of the asphalt pavement can be improved.

Further, since the number of times of vibration of the compaction construction on the new asphalt road surface is controlled between 10 and 15 times, preferably 10 to 12 times per foot of the road surface to be constructed, the compaction density in the construction target range can be made uniform, and the construction quality of the asphalt pavement can be improved.

Further, according to the vibrating roller 10, the first drum 11 as the front wheel may start vibration at a timing just before the time required from a timing at which the first drum 11 as the front wheel reaches the new asphalt road surface until the vibration frequency of the first drum 11 as the front wheel reaches the set IPF (10 to 15 times). Therefore, since the predetermined number of times of vibration can be accurately given to the new asphalt road surface by the first drum 11 as the front wheel, the compaction density in the construction target range can be made uniform, and the construction quality of the asphalt pavement can be improved.

Further, according to the control device and the control method of the vibrating roller according to the present embodiment, similarly to the vibrating roller 10, since it is possible to reduce an impact due to vibration of the second drum 12 as the rear wheel on the existing asphalt road surface during construction of asphalt pavement, it is possible to reduce damage from occurring on the existing road surface. Further, since the rear wheel vibration start signal is output based on the timing T1 calculated by the calculation unit 4, it is possible to accurately give a predetermined number of times of vibration to the new asphalt road surface, and it is possible to make the compaction density in the construction target range uniform.

Incidentally, in a general vibrating roller, the hydraulic motor requires largest power at a timing when the vibrating roller starts travelling and a timing when the vibration exciting shaft including the eccentric weight is rotated by the vibration exciting motor. On the other hand, after the vibrating roller starts travelling and after the vibration generated on the drum stabilizes by rotating the vibration shaft, large power by the hydraulic motor is not required as compared with the above timings.

In contrast, according to the vibrating roller 10 including the control device 1 according to the present embodiment, since timings at which the first drum 11 as the front wheel and the second drum 12 as the rear wheel start vibration are different, it is possible to reduce a peak load of the engine E which operates the vibration hydraulic pumps P2 which operate the front vibration exciting motor M3 and the rear vibration exciting motor M4 respectively (see, for example, the timing of the arrow A in FIG. 8). Therefore, downsizing of the power source such as the vibration hydraulic pump P2 and the engine E is also possible.

Although the embodiment of the present invention has been described above, it is needless to say that the technical scope of the present invention should not be interpreted as being limited to the description of the embodiment. It is to be understood by those skilled in the art that the present embodiment is merely an example and various embodiments can be modified within the scope of the invention described in the claims. The technical scope of the present invention should be determined based on the scope of the invention described in the claims and the equivalent scope thereof.

In the above embodiment, the vibrating roller 10 including the first drum 11 and the second drum 12 is illustrated, but the present invention is not limited thereto, and may be, for example, a vibrating roller including a drum (iron wheel) and a tire. Further, although the vibrating roller 10 for generating vibration on both the first drum 11 and the second drum 12 is illustrated, vibration may be generated on either of the drums. In addition, the present invention can be applied not only to an articulated type but also to a rigid frame type, and may be applied to a tire roller, a macadam roller, or the like.

What is claimed is:

1. A controller for controlling a vibrating roller that generates vibration on a front wheel and a rear wheel by rotating a vibration exciting shaft including an eccentric weight provided inside the front wheel and the rear wheel with respect to a proceeding direction by a vibration exciting motor, the controller configured to:

calculate a front wheel vibration start timing for starting vibration of the front wheel and calculate a rear wheel vibration start timing for starting vibration of the rear wheel, the front wheel vibration start timing and the rear wheel start vibration timing representing a time width required from the start of vibration of each of the front wheel and the rear wheel until a desired vibration frequency is obtained at a time before the front wheel and the rear wheel reach a boundary position of a road surface to be constructed;

output a front wheel vibration start signal for starting vibration of the front wheel based on the front wheel vibration start timing calculated; and output a rear wheel vibration start signal for starting vibration of the rear wheel based on the rear wheel vibration start timing calculated; and set timings at which the front wheel and the rear wheel pass the same position on the road surface to be constructed.

2. The controller according to claim 1, further configured to calculate the time width from the front wheel vibration start timing to the rear wheel vibration start timing based on a travelling speed of the vibrating roller and a wheel base between the front wheel and the rear wheel.

3. The controller according to claim 1, wherein the desired vibration frequency is obtained at a time vibration frequency reaches a predetermined number of times is set between 10 and 15 times per foot of the road surface to be constructed.

4. The controller according to claim 3, wherein the predetermined number of times is between 10 and 12 times per foot of the road surface to be constructed.

5. A vibrating roller comprising:

a pair of drums as a front wheel and a pair of drums as a rear wheel, each pair of drums including a vibration exciting shaft having an eccentric weight inside;

a vibration exciting motor for vibrating one or both of the pair of drums; and the controller according to claim 1.

6. A control method for controlling a vibrating roller that generates vibration on a drum by rotating a vibration exciting shaft including an eccentric weight provided inside one or both of a front wheel and a rear wheel with respect to a proceeding direction by a vibration exciting motor, the control method comprising:

calculating a front wheel vibration start timing for starting vibration of the front wheel and calculating a rear wheel vibration start timing for starting vibration of the rear wheel, the front wheel vibration start timing and the rear wheel start vibration timing representing a time width required from the start of vibration of each of the front wheel and the rear wheel until a desired vibration frequency is obtained at a time before the front wheel and the rear wheel reach a boundary position of a road surface to be constructed;

starting vibration of the drum, which is the front wheel, so as to provide vibration a predetermined number of times to the road surface to be constructed per unit length;

starting vibration of the front wheel based on the calculated front wheel vibration start timing;

starting vibration of the rear wheel based on the calculated rear wheel vibration start timing;

calculating a timing at which the drum, which is the front wheel starts vibration and the drum, which is the rear wheel, is able to vibrate the road surface to be constructed at the predetermined number of times per unit length;

starting vibration of the drum, which is the rear wheel, at the calculated timing; and set timings at which the front wheel and the rear wheel pass the same position on the road surface to be constructed.

* * * * *